United States Patent [19]

Myslicki et al.

[11] Patent Number: 4,946,208

[45] Date of Patent: Aug. 7, 1990

[54] ADJUSTABLE STRIKER ASSEMBLY WITH ANTI-THEFT PROTECTION

[75] Inventors: Robert J. Myslicki, West Bloomfield; Carl D. May, Farmington Hills; Douglas L. Rusnell, Lake Orion, all of Mich.

[73] Assignee: General Motors Corporation, Detroit, Mich.

[21] Appl. No.: 364,948

[22] Filed: Jun. 12, 1989

[51] Int. Cl.[5] ..... E05C 3/26

[52] U.S. Cl. ..... 292/216; 292/341.18; 292/DIG. 43; 292/DIG. 53

[58] Field of Search ..... 292/341.18, 341.19, 292/216, DIG. 43, DIG. 14, DIG. 53, DIG. 60

[56] References Cited

U.S. PATENT DOCUMENTS

| | | | |
|---|---|---|---|
| 769,770 | 9/1904 | Phelps | 292/341.18 |
| 1,987,513 | 1/1935 | Lindberg | 292/341.18 X |
| 2,144,075 | 1/1939 | Mora | 292/341.18 X |
| 2,275,760 | 3/1912 | Hoffman | 292/341.19 X |
| 2,886,365 | 5/1959 | Fox et al. | 292/341.18 |
| 2,930,645 | 3/1960 | Dall | 292/109 |
| 2,996,327 | 8/1961 | France et al. | 292/340 |
| 4,470,626 | 9/1984 | Gergo et al. | 292/341.12 |
| 4,756,565 | 7/1988 | Myslicki et al. | 292/340 |

*Primary Examiner*—Richard E. Moore
*Attorney, Agent, or Firm*—William A. Schuetz

[57] ABSTRACT

A striker assembly includes a striker member fixed to mounting bracket. Studs secured to the bracket extend outwardly through enlarged openings in the body member. Nuts and washers secure the brackets to the member and permit exterior adjustment of the bracket and striker with the closure closed and latched to the striker member. Anti-theft means in the form of a round convex headed stud which extends through aligned openings in the body panel and the support bracket. A nut secures the round headed stud to the second bracket and with the stud clampingly engaging the exterior side of the body panel so that it cannot be removed by any tool.

3 Claims, 2 Drawing Sheets

ADJUSTABLE STRIKER ASSEMBLY WITH ANTI-THEFT PROTECTION

The present invention relates to a striker assembly for use with a lock mechanism for a vehicle closure and, more particularly, to an exteriorly adjustable deck lid lock striker assembly which has anti-theft protection means.

U.S. Pat. No. 4,756,565, assigned to the same assignee as the present invention, discloses an adjustable deck lid lock striker assembly which has anti-theft protection means. The deck lid striker assembly of this patent permitted the position of the deck lid within a deck lid opening to be adjusted and set from the exterior of the vehicle with the deck lid closed and the deck lid locked or latched to the deck lid striker assembly. This enabled the deck lid to be easily and quickly adjusted and set in a desired position within the deck lid opening during production of the vehicle.

As shown in the aforementioned patent, the striker assembly included a striker member fixed to a first mounting bracket located interiorly of a deck lid compartment and which was attached to a rear wall or end panel defining the compartment. The mounting bracket carried threaded studs which extended outwardly to the exterior side of the vehicle through enlarged apertures in the rear end panel of the vehicle. Exterior nuts were threaded onto the studs to mount the striker member and support to the rear end panel of the vehicle. After the nuts were frictionally tightened against the exterior side of the rear panel, the deck lid was closed to latch the deck lid to the striker member. The deck lid could then be adjusted to the desired position within the deck lid opening of the vehicle by moving the studs, and the nuts frictionally relative to the exterior side of the panel. Once the desired position was set, the nuts could be tightened to fix the position of the first mounting bracket and striker member within the deck lid compartment of the vehicle.

Since the nuts were accessible from the exterior of the vehicle, an anti-theft protection means was provided to ensure that the deck lid striker support could not be dismounted from the rear end panel of the vehicle should the nuts be removed or released. The anti-theft protection shown included a second mounting bracket secured to the interior side of the rear end panel and provided with a stud which extended through an enlarged opening in the striker support member or first mounting bracket. Once the position of the deck lid within the deck lid opening was fixed, a nut means threaded onto the stud of the second mounting bracket and tightened prevented dismounting of the first mounting bracket should the exterior nuts be removed in an attempt to gain unauthorized access into the deck lid compartment.

The present invention provides a novel striker assembly which achieves the same end results of the striker assembly shown in the aforementioned patent, but accomplishes these results in a simplified and more economical manner. In accordance with the provisions of the present invention, the anti-theft protection means comprises a stud having a round convex head and which extends through an aperture in the rear panel and an enlarged aperture in the support mounting bracket for the striker. A nut is secured to the stud to clampingly engage the striker support member and with the head of the stud at its underside clampingly engaging the rear end panel at its exterior side. Since a round convex head of the stud cannot be engaged by any tool for removal it provides an anti-theft deterrence. This structure also eliminates the need for an extra bracket or support mounted on the interior side of the rear end panel, as disclosed in the aforementioned U.S. Pat. No. 4,756,565.

Accordingly, an important object of the present invention is to provide a new and improved striker assembly which permits the position of a deck lid within a deck lid opening to be adjustably set from the exterior of the vehicle with the deck lid closed and its latch or lock latched to the deck lid striker so that all adjustments for the deck lid position can be accomplished from the exterior of the vehicle, and in which the striker assembly includes an anti-theft means in the form of a convex headed bolt extending through the rear end panel of the vehicle and through an enlarged opening in the striker support plate and which can be secured in place by a nut after the position of the striker assembly is set so that the underside of the convex headed bolt will clampingly engage the exterior side of the vehicle so that even if the exteriorly accessible means for adjusting the position of the striker assembly can be undone, the deck lid is held in place by the anti-theft means.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figures 1, 4:
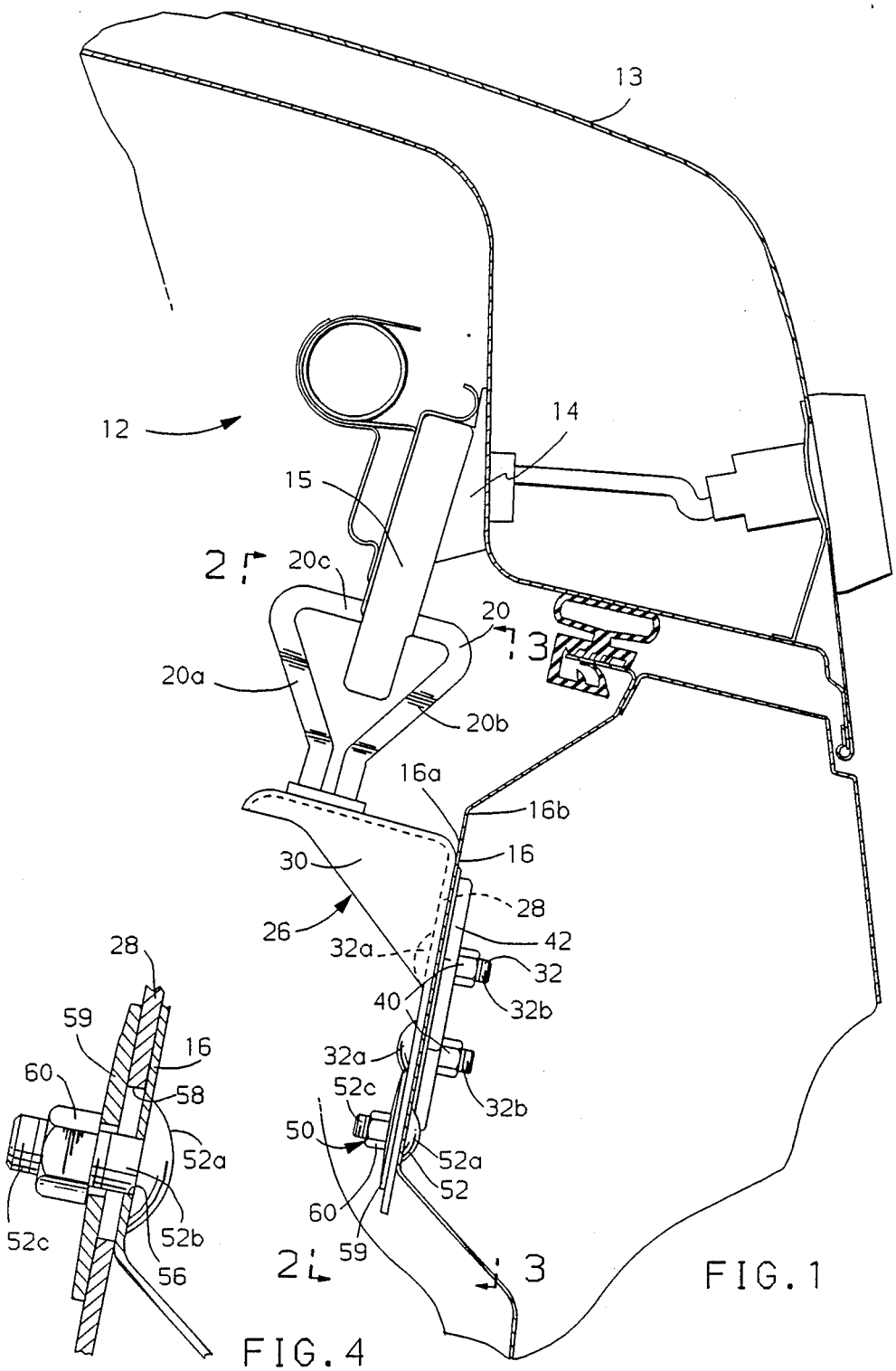
FIG. 1 is a side elevational view of the novel striker assembly of the present invention and showing the same mounted to a rear end panel of an automotive vehicle and disposed beneath a deck lid and its associated latch means.
FIG. 4 is an enlarged fragmentary sectional view taken along the lines 4—4 of FIG. 3.

The present invention provides a novel striker assembly 10 for use with a vehicle having a conventional rear or deck compartment 12 which is adapted to be opened and closed by a conventional deck lid 13 which is hinged adjacent its forward edge to vehicle body structure (not shown) for opening and closing movement relative to the deck compartment 12. The deck lid adjacent its rear edge would carry a conventional deck lid latch or latch means 14 which would include a conventional latch bolt 15 for latching engagement to and unlatching disengagement from the striker assembly 10.

Figure 2:
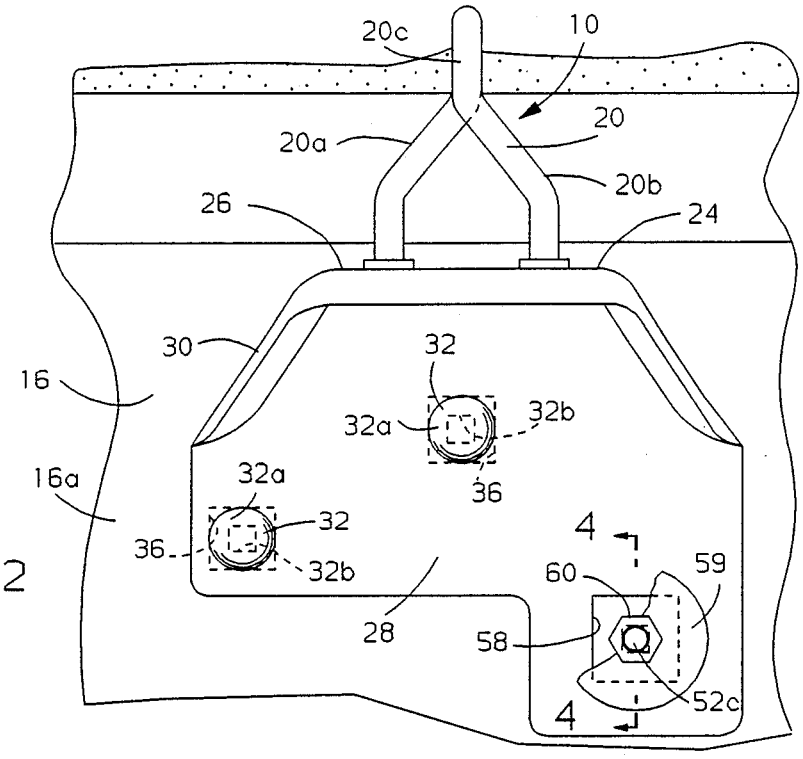
FIG. 2 is a fragmentary front elevational view and looking in the direction of the arrows 2—2 of FIG. 1.
Figure 3:
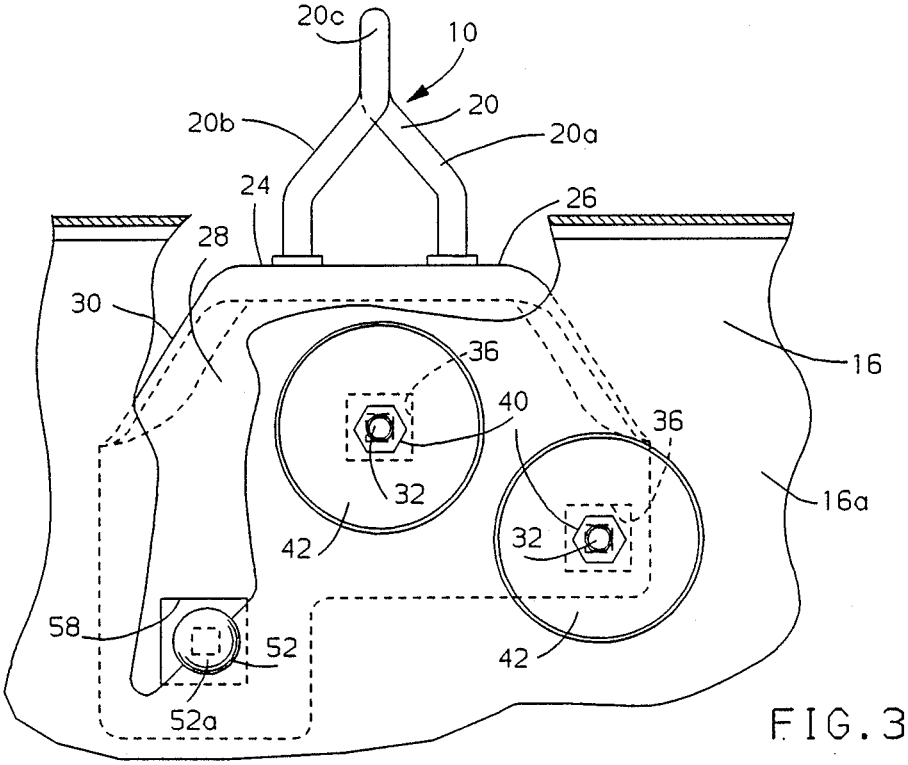
FIG. 3 is a fragmentary rear elevational view of the striker assembly and looking in the direction of the arrows 3—3 of FIG. 1.

The striker assembly 10 is adapted to be mounted to a generally vertically disposed rear end panel 16 of the vehicle and which defines in part the compartment 12. The striker assembly 10 includes a rod-like striker member 20 which is of a generally inverted U-shape, as viewed in side elevation in FIG. 1, and which has its opposite legs 20*a*, 20*b* offset from each other, as shown in FIG. 2. The legs 20*a* and 20*b* at their free ends are staked to a horizontally disposed flange or upper leg 24 of a striker support member or bracket 26. The striker 20 includes a generally horizontally disposed bight or bight portion 20c which is adapted to be engaged by a latch bolt 15 on a latch means 14 carried by the deck lid 13. The striker support member 26 also has a generally vertically disposed flange or leg 28 which is adapted to be mounted or clamped against the rear end panel 16 at its interior side 16a. The striker support member 26 also includes a pair of spaced vertical sides 30 which are generally triangular in shape and which serve as stiffening members to make the support member 26 more rigid.

The striker support member 26 is adapted to be mounted to the rear end panel 16 via first and second spaced apart threaded studs or stud means 32. The studs 32 are preferably staked at their head ends 32a to the leg 28 of the striker support member and have their threaded shanks 32b extend rearwardly through enlarged square shaped openings 36 in the rear end panel 16 to the exterior side 16b of the end panel 16. The diameter or maximum transverse dimension of the studs is less than the maximum transverse dimension of the square shaped openings 36 in the rear panel 16, and for a reason to be hereinafter more fully described. The striker support member 26 is adapted to be clamped against the interior side 16a of the rear panel 16 via first and second nuts or nut means 40 which are threadably secured to the shanks 32b of the studs 32. Suitable enlarged washers 42 are interposed between the exterior side 16b of the end panel 16 and the nuts 40 to cover the enlarged openings 36.

In order to adjust or set the position of the deck lid 13 relative to the opening of the deck compartment 12, the first and second studs 32 of the striker assembly 10 are inserted through the enlarged openings 36 of the end panel 16 and the nuts 40 are then threaded onto the shanks 32b of the studs 32 and partially tightened to frictionally engage the washers 42 against the exterior side 16b of the end panel 16. The deck lid 13 is then closed and with the deck lid latch means 14 being engaged with the striker member 20. The deck lid 13 is then adjusted relative to the opening of the deck lid compartment 12 by moving the studs 32 within the openings 36 of the rear end panel 16 and with the washers 42 and nuts 40 moving relative to the exterior side 16b of the rear end panel 16. Once the position of the deck lid is set, the nuts 40 are fully tightened to fix the striker assembly 10 in its adjusted position.

The striker assembly 10 of the present invention also includes a simplified anti-theft protection means 50 to prevent unauthorized entry into the deck lid compartment 12 should the nuts 40 be removed. To this end, a third stud or bolt means 52 is provided. The third stud means 52 in the form of a carriage bolt having a round convex head 52a, a square portion 52b adjacent the head 52a and a threaded shank 52c. The head 52a at its underside is planar and extends normal to the longitudinal axis of the bolt 52. The shank 52c extends through a third aperture 56 in the rear end panel 16 and also extends through an enlarged square shaped aperture 58 in the leg 28 of the support member 26. The aperture 56 is square shaped to receive the square portion 52b of the bolt 52 so that the latter cannot rotate relative to the rear end panel 16. The diameter or maximum transverse dimension of the shank 52c of the bolt 52 is less than the transverse dimension of the square aperture 58 in the support plate 26. The convex head 52a of the bolt is adapted to be clamped against the exterior side 16b of the rear panel via a washer 59 and a nut 60 threadably engaged with the shank portion 52c of the bolt 52 and which, when tightened, also clamps through the washer 59 of the leg 28 of the support member 26 to the end panel 16.

Thus after the striker assembly 10 has been adjustably positioned and the first and second stud means 32 secured in place, the third stud means 52 can then be inserted from the rear through the aligned apertures 56, 58 in the rear end panel 16 and the support plate 26, respectively, and then the nut 60 tightened. This operation will take place after the deck lid is reopened subsequent to the striker assembly 10 having been adjustably positioned. The provision of the round convex head 52a provides anti-theft protection in that no tool can engage the rounded head to remove the third stud means 52. Thus, once the third stud means 52 is tightly secured in place, the deck lid support member 26 cannot be removed from the rear end panel 16 even if the nuts 40 are removed. Thus, the deck lid will remain closed and latched in place to block any unauthorized entry into the deck compartment 12.

It should also be noted that the studs 32 and 52 are spaced from each other to define an imaginary triangle, as shown in FIG. 2. This triangulated attachment arrangement provides a three point attachment for the support member 26.

From the foregoing, it should be apparent that the present invention provides an improved striker assembly 10 which not only includes exteriorly accessible attachment means which permits adjustment of the position of the deck lid relative to the deck compartment opening with the deck lid closed and latched to the vehicle from the exterior of the vehicle, but which also includes a simple anti-theft protection means against unauthorized entry into the deck compartment should the exteriorly accessible attachment means be removed.

Although the present invention has been described with reference for use with a vehicle deck lid, it could be applied to other vehicle closures, such as hoods, tailgates, etc.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. In combination with a vehicle having a compartment which is defined in part by a vehicle panel having interior and exterior sides and first and second apertures therethrough, a vehicle closure which is mounted on the vehicle for movement between open and closed positions with respect to the compartment, and latch means mounted on the closure, a striker assembly mounted on the vehicle panel comprising, a striker support member having an aperture therethrough, a striker mounted to the support member for engagement by the latch means to hold the closure in a closed position, first stud means of a given diameter carried by the striker support member and extending through said first aperture of the vehicle panel to the exterior side of the vehicle panel, nut means threaded on the stud means on the exterior side of the vehicle panel for securing the stud means and the striker support member to the vehicle panel, said first aperture in said vehicle panel having a maximum transverse dimension which is greater than the given diameter of said first stud means to permit the stud means to be engaged from the exterior side of the vehicle panel and moved within the first aperture in said vehicle panel to adjust the position of the striker support member and striker relative to the compartment when the closure in in a closed position and the latch means is engaged with the striker, and anti-theft means preventing release of the striker support member from the vehicle panel and movement of the closure from its closed position to an open position should the nut means be released, the anti-theft means including second stud means carried by and extending through said second aperture of said vehicle panel and extending through the aperture in the striker support member, said second stud means having a round convex head located on the exterior side of said vehicle panel, and securing means operatively connected to said second stud means for securing the striker support member to the vehicle panel and with said rounded convex head at its underside clampingly engaging the exterior side of said vehicle panel after the striker support member has been secured to the vehicle panel, the second stud means being of lesser transverse dimension than the transverse dimension of said aperture in said striker support member aperture to permit adjustment of the striker support member and first stud means relative to the second stud means.

2. In combination with a vehicle having a compartment which is defined in part by a vehicle panel having interior and exterior sides and first and second apertures therethrough, a vehicle closure which is mounted on the vehicle for movement between open and closed positions with respect to the compartment, and latch means mounted on the closure, a striker assembly mounted on the vehicle panel comprising, a striker support member provided with an aperture therethrough, a striker mounted to the support member for engagement by the latch means to hold the closure in a closed position, first stud means secured to the striker support member and extending through the first aperture of said vehicle panel to the exterior side of the vehicle panel, first nut means threaded on the stud means on the exterior side of the vehicle panel for securing the stud means and striker support member to the vehicle panel, the stud means being of lesser diameter than the maximum transverse dimension of said first aperture in said vehicle panel to permit the stud means to be engaged from the exterior side of the vehicle panel and moved within the first aperture in said vehicle panel to adjust the position of said striker support member and striker relative to the compartment when the closure is in a closed position and the latch means is engaged with the striker, and anti-theft means preventing release of the striker support member from the vehicle panel and movement of the closure from its closed position to an open position should the nut means be released, the anti-theft means including a second stud means having a round convex head located on the exterior side of said vehicle panel and a threaded shank extending through the second aperture in said vehicle panel and the aperture in the striker support member, and second nut means being threadedly engaged with said threaded shank of said second stud means for securing the striker support member to the vehicle panel when tightened and with the round convex head at its underside clampingly engaging the exterior side of said vehicle panel after the striker support member has been secured to the vehicle panel, the second stud means being of lesser diameter thank the maximum transverse dimension of said aperture in said striker support member to permit adjustment of the striker support member and first stud means relative to the second stud means.

3. In combination with a vehicle having a compartment which is defined in part by a vehicle panel having interior and exterior sides and first, second and third spaced apertures therethrough, a vehicle closure which is mounted on the vehicle for movement between open and closed positions with respect to the compartment, and latch means mounted on the closure, a striker assembly mounted on the vehicle panel comprising, a striker support member having a leg portion provided with an aperture therethrough, a striker mounted to the support member for engagement by the latch means to hold the closure in a closed position, first and second spaced stud means secured to the leg portion of the striker support member and triangulated with respect to the support member aperture, said first and second stud means extending through said first and second vehicle panel apertures to the exterior side of the vehicle panel, first and second nut means respectively threaded onto the first and second stud means on the exterior side of the vehicle panel or securing such stud means and striker support member to the exterior side of the vehicle panel, said first and second stud means being of lesser transverse size than the transverse size of said first and second vehicle panel apertures to permit said first and second stud means to be engaged from the exterior side of the vehicle panel and moved within their respective vehicle panel apertures to adjust the position of the striker support member and striker relative to the compartment when the closure is in a closed position and the latch means is engaged with the striker, and anti-theft means for preventing release of the striker support member from the vehicle panel and movement of the closure from its closed position to an open position should the first and second nut means be released, the anti-theft means including a third stud means having a round convex head located on the exterior side of said vehicle panel and a threaded shank extending through the third aperture in said vehicle panel and said aperture in the striker support member, and third nut means threadedly engaged with said shank of said third stud means for clamping the leg portion of the striker support member to the vehicle panel and with the round convex head at its underside clampingly engaging the exterior side of said vehicle panel after the striker support member has been secured to the vehicle panel via the first and second nut means, the third stud means being of lesser transverse size than transverse size of said aperture in the striker support member to permit adjustment of the striker support member and first and second stud means relative to the third stud means

* * * * *